US011784448B2

(12) United States Patent
Frei et al.

(10) Patent No.: US 11,784,448 B2
(45) Date of Patent: Oct. 10, 2023

(54) TRAVEL ADAPTER AND SET COMPRISING A TRAVEL ADAPTER

(71) Applicant: WORLDCONNECT AG, Widnau (CH)

(72) Inventors: Christian Frei, Oberriet (CH); Remo Jud, Jakobsbad (CH); Erich Hinderegger, Lochau (AT)

(73) Assignee: WorldConnect AG, Widnau (CH)

( * ) Notice: Subject to any disclaimer, the term of this patent is extended or adjusted under 35 U.S.C. 154(b) by 285 days.

(21) Appl. No.: 17/417,077

(22) PCT Filed: Dec. 20, 2019

(86) PCT No.: PCT/IB2019/061172

§ 371 (c)(1),
(2) Date: Jun. 21, 2021

(87) PCT Pub. No.: WO2020/128992

PCT Pub. Date: Jun. 25, 2020

(65) Prior Publication Data

US 2022/0077640 A1 Mar. 10, 2022

(30) Foreign Application Priority Data

Dec. 21, 2018 (EP) ..... 18215236

(51) Int. Cl.
*H01R 27/00* (2006.01)
*H01R 31/06* (2006.01)
*H01R 35/04* (2006.01)

(52) U.S. Cl.
CPC ..... *H01R 27/00* (2013.01); *H01R 31/065* (2013.01); *H01R 35/04* (2013.01)

(58) Field of Classification Search
CPC ..... H01R 27/00; H01R 31/065; H01R 35/04
See application file for complete search history.

(56) References Cited

U.S. PATENT DOCUMENTS 8,240,443 B2 * 8/2012 Vahabzadeh ..... F02B 67/08 192/3.3
8,708,722 B1 * 4/2014 Walliser ..... H01R 31/065 439/337

(Continued)

FOREIGN PATENT DOCUMENTS

CA 2961248 A1 6/2017
CN 104124588 A 10/2014

(Continued)

OTHER PUBLICATIONS

PCT International Search Report for PCT/IB2019/061172, dated Jun. 23, 2020, 8 pages.

(Continued)

*Primary Examiner* — Phuong Chi Thi Nguyen
(74) *Attorney, Agent, or Firm* — MORRISS O'BRYANT COMPAGNI CANNON, PLLC

(57) ABSTRACT

The invention relates to a travel adapter, comprising a housing, at least one receptacle of a first standard and at least one plug of a second standard. The receptacle of the first standard has at least one first contact socket and one second contact socket. The plug of the second standard has at least one first contact pin and one second contact pin. The plug is arranged on the housing. The receptacle is rotatably mounted in the housing. The plug or the first contact pin and the second contact pin are pivotally arranged on the housing in such a way that the plug or the first contact pin and the second contact pin can be pivoted out of the housing. The invention also relates to a set and an additional travel adapter.

20 Claims, 7 Drawing Sheets

(56) References Cited

U.S. PATENT DOCUMENTS

Figure 1:
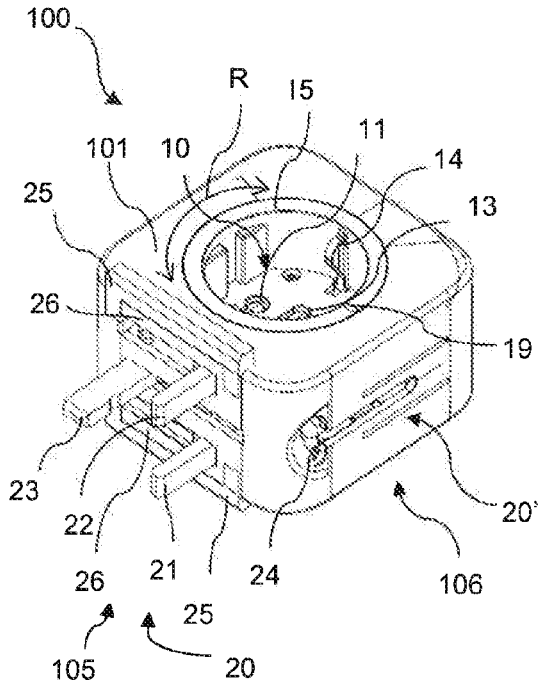

| | | | | |
|---|---|---|---|---|
| D726,653 | S * | 4/2015 | Kourtis | D13/137.1 |
| 9,952,630 | B2 * | 4/2018 | Boilard | H01R 31/06 |
| 10,505,308 | B1 * | 12/2019 | Dvorak | H01R 13/504 |

FOREIGN PATENT DOCUMENTS

| | | | |
|---|---|---|---|
| DE | 19902642 | A1 | 7/2000 |
| DE | 102012106538 | A1 | 1/2014 |
| EP | 1257018 | B1 | 11/2002 |
| GB | 2522805 | A | 8/2015 |
| TW | I627801 | B | 6/2018 |
| TW | I644488 | B | 12/2018 |

OTHER PUBLICATIONS

PCT Written Opinion of the International Searching Authority for PCT/IB2019/061172, dated Jun. 23, 2020, 12 pages.

* cited by examiner

TRAVEL ADAPTER AND SET COMPRISING A TRAVEL ADAPTER

CROSS-REFERENCE TO RELATED APPLICATIONS

This application is a national phase entry under 37 U.S.C § 371 of PCT/IB2019/061172 filed Dec. 20, 2019, which claims priority to European Patent Application No. 18215236.3 filed Dec. 21, 2018, the entirety of each of which is incorporated by this reference.

FIELD OF THE INVENTION

The invention relates to travel adapters and a set comprising the travel adapter.

BACKGROUND OF THE INVENTION

Electrical adapters, particularly those described as travel adapters, are known per se. They consist of at least one plug and at least one receptacle. The plug includes a contact device, which has been or can be adapted to country-specific standards (standards for short) of the receptacle. The receptacle has at least two contact apertures which are shaped and set at a distance from each other in such a way that a contact device of a power plug of an electrical device, for example the contact device of the type C power plug (CEE 7/16) can be connected to them.

CN 104 124 588 A discloses a travel adapter with a housing which is constructed in two parts. The housing includes a lower housing part with a plurality of plugs, and an upper housing part. The upper housing part is rotatable and has plug apertures for an external plug. The upper housing part can be pivoted into various positions. An electrical contact is created with one of the plugs that conforms to a different standard in the lower housing part depending on the position of the upper housing part. The selected plugs can be pivoted out of the housing manually as necessary.

The advantage of this known solution is that the pivotable housing part is mounted on the lower housing, and consequently the construction size of the travel adapters is impractical for the user. Moreover, the two housing parts are separated from each other by a gap which extends around the circumference, in which dirt and/or foreign bodies can collect during proper use, while travelling for example. This presents an increased risk of incorrect operation by the user.

DE 10 2012 106528 A1 discloses a travel adapter with a housing, wherein multiple plug apertures are provided on the housing for attaching external plugs conforming to various standards. The housing includes a plurality of plugs with various standards, wherein said plugs can be selectively taken out of the housing. Sliding elements are arranged inside the housing, and these prevent the introduction of foreign bodies into the plug aperture.

EP 1 257 018 B1 discloses an electrical plug adapter for selectively connecting a plug system as a plug to various country-specific plug systems. The plug adapter has a housing, with a number of different, protruding plug systems on the outer circumference thereof, and with a socket receptacle which is mounted pivotably in the housing as the receptacle. The socket receptacle is equipped with electrical contacts, which can be connected to corresponding electrical contacts of the respective plug systems in each of the rotational positions of the socket receptacle that are assigned to the outer plug systems, wherein one of the plug systems has a protective contact pin which is mounted so as to be movable in the housing.

DE 199 02 642 A1 discloses a travel multi-plug with a housing, the lateral flanks of which are provided with plugs conforming to various country standards, and with a socket as the receptacle which is arranged on the housing so as to be pivotable relative to the housing and which is connected electrically and mechanically to a contact pair. The contact pair bears under spring tension on one of several contact surface pairs in each case depending on the relative rotational positions of the socket and the housing. The contact surface pairs are connected to the contact pins of one plug in each case.

The disadvantage of these known solutions is that they have a complex construction, so not only are they confusing to an inexperienced user merely with regard to the correct use of the travel adapter, but they also offer the user no protection against using the travel adapter incorrectly in the respective country.

The present invention remedies one or more of the drawbacks of the related art. In particular, a travel adapter is to be produced which is usable in countries with different standards and which is more effectively operable by the user in the respective countries. In particular, it is intended to create a set comprising the travel adapter which can be used easily in many countries, and with improved operability.

The travel adapter and travel adapter sets of the present invention are defined in the independent claims. Advantageous further developments are presented in the figures, the description, and in the dependent claims.

SUMMARY OF THE INVENTION

A travel adapter according to the invention comprises a housing, at least one receptacle of a first standard, and at least one plug of a second standard. The receptacle of the first standard has at least one first contact socket and one second contact socket, and the at least one plug of the second standard has at least one first contact pin and one second contact pin. The plug is arranged on the housing and the receptacle is rotatably mounted on the housing. The receptacle has a receptacle housing, wherein contact elements are arranged inside the receptacle housing are each connected to the first contact socket and the second contact socket of the receptacle. The contact elements may be electrically connected to each of the first contact pin or the second contact pin of the respective plug by twisting the receptacle relative to the housing into an operating position that corresponds to the respective plug. The at least one plug or the first contact pin and the second contact pin are arranged pivotably on the housing, in such manner that the at least one plug or the first contact pin and that second contact pin may be pivoted out of the housing.

The travel adapter according to the invention is usable in countries with different standards, and at the same time its operability for the user in the respective countries is also improved. Moreover, this travel adapter has a compact, sturdy construction. And there is only a single operating position for the plug or for the first contact pin and the second contact pin.

The operating position is that end position in which the plug or the first contact pin and the second contact pin are pivoted out and can be plugged into an external or separate receptacle. The opposite of this, the rest position is that end position in which the plug or the first contact pin and the second contact pin are pivoted in and at least a section thereof is pivoted inside the housing.

The plugs or the first contact pin and the second contact pin are arranged in such manner that they are pivotable out of the rest position on the housing. At the same time, the plugs or the first contact pin and the second contact pin may be arranged substantially freely on the housing, with the result that their functional use is substantially comparable to the arrangement of the plug or the first contact pin and the second contact pin inside the housing. The arrangement inside the housing prevents the plug or the first contact pin and the second contact pin from becoming caught on other objects, for example objects such as luggage, which may be located in the immediate surroundings of the travel adapter.

The respective contact elements may be constructed integrally with the respective contact sockets. In this way, the contact elements can be prevented from becoming detached from the contact sockets in the housing, which in turn helps to improve the functional reliability of the travel adapter.

The first contact pin and the second contact pin may be coupled to one another in such manner that they can be pivoted out of the housing together. The first contact pin and the second contact pin can thus be moved from their rest position into their operating position synchronously. Accordingly, they reach their operating position at the same time, so that the user is able to plug them into an external or separate receptacle without difficulty.

The receptacle may have a contact blade for making a protective earth connection, and the at least one plug has a third contact pin as a protective earthing pin, wherein a third contact element is arranged inside the receptacle housing and is connected to the contact blade, and where in the first contact pin and the second contact pin and the third contact pin are coupled to one another in such a way that they can be pivoted out of the housing together. This means that the travel adapter can also be used in those countries in which a protective conductor system is mandatory. The contact blade can be connected to the third contact pin with the aid of the third contact element. The third contact element is arranged on the receptacle housing, which means it is mounted pivotably in the travel adapter housing. The coupling of the contact pins enables synchronous movement of all three contact pins, so that they can easily be moved to their respective operating positions.

The third contact pin may be moved linearly. The third contact pin may also be embodied as a protective earth pin, which may be located between the first contact pin and the second contact pin. The protective earth pin may also be movable normally to the connecting line that extends between the first contact pin and the second contact pin. For example, a plug with a linearly movable protective earth pin has a slot in which the protective earth pin can move linearly. In this context, a linear movement is a movement along the lengthwise extension of the slot. In this way, the Swiss plug standard, the Italian plug standard and the Brazilian plug standard can be satisfied with one and the same plug.

Alternatively or in addition to the contact blade, the receptacle has a third contact socket making a protective earth connection. As described previously, the third contact socket may also be connected to the third contact pin with the aid of the third contact element. In addition to the advantages described earlier, a travel adapter with three contact sockets has a simple construction, which retains an external or separate plug firmly after it is plugged into the receptacle.

The first contact pin and the second contact pin may be pivoted out in a first pivot direction, and the third contact pin may be pivoted out in a second pivot direction opposite to the first pivot direction. This makes it possible for the contact pins to arranged in space-saving manner in the rest position in the travel adapter housing. The third contact pin is constructed as the protective earth pin, so that it is pivotable in the opposite direction to the first and the second contact pins.

In addition to the abovementioned arrangement, the third contact pin may be both linearly movable and pivotably movable. Accordingly the options for using the third contact pin, which is designed as the protective earth pin, are particularly wide ranging.

A gear mechanism may be provided for coupling. A gear mechanism for the contact pins that can be pivoted out together has the effect of moving these contact pins synchronously when the are pivoted out into their operating position.

In particular, a gear mechanism is provided for coupling the contact pins. A gear mechanism has tooth systems enabling efficient coupling of the contact pins which can be pivoted out together, the gear mechanism being of compact construction. The contact pins are movable precisely from their rest positions into their operating positions and back again with the aid of the tooth systems.

Alternatively or additionally, a coupling rod gear mechanism is provided as coupling for the contact pins. A coupling rod gear mechanism enables particularly reliable coupling of the contact pins that are to be moved together. In this way, the contact pins are exposed to very little mechanical load, which can help to prolong the service life of the travel adapter.

In particular, gearing notch is provided on the gear mechanism to accommodate at least one of the contact pins. This enables an improved, compact construction of the travel adapter since the contact pins are arranged in space-saving manner in their rest position in the housing. For example, when pivoted inwards in its rest position, the third contact pin is arranged inside the gearing notch.

The travel adapter may include an unlocking mechanism, which enables the respective plug or the first contact pin and the second contact pin to be pivoted out when the receptacle is in the appropriate operating position. At the same time, the unlocking mechanism may also prevent the other plugs or first contact pins and second contact pins from being pivoted out, so that they are forced to remain in their rest positions. This means that having selected the desired standard the user is then only able to use the plug or the first contact pin and second contact pin that matches this standard.

The unlocking mechanism may be constructed in at least two parts and has an unlocking guide channel and an engaging element. In this context, the unlocking guide channel and the engaging element cooperate in such a way that reliable unlocking is possible and jamming of the plugs and/or contact pins may be prevented. The unlocking mechanism is advantageously constructed in two parts and is accordingly of simple structural design.

The unlocking guide channel may be arranged on the receptacle housing and the engaging element is arranged on the plug. The arrangement of the unlocking guide channel on the receptacle housing enables stable actuation of the unlocking mechanism when the receptacle is rotated. The engaging element may be arranged on the plug or the first contact pin and/or second contact pin, but also on the coupling or the gear mechanism, so that the engaging element can be located close to the receptacle housing and it is thus possible to ensure reliable, stable interaction between the unlocking guide channel and the engaging element.

At least one further plug with a further standard may be arranged on the housing, wherein the further plug has at least one further first contact pin and one further second contact pin. The contact elements of the receptacle may each be connected electrically to the further first contact pin or the further second contact pin of the further plug by twisting the receptacle relative to the housing into an operating position corresponding to the respective plug. The further plug or the further first contact pin and the further second contact pin are arranged pivotably on the housing, in such manner that the further plug or the further first contact pin and the further second contact pin can be pivoted out of the housing.

With the travel adapter, having selected the desired country on the travel adapter the user is only able to move the plug or the first contact pin and second contact pin that is/are suitable for the desired country into the operating position. In this context, only one operating position is possible for the plug or for the first contact pin and the second contact pin. In this way, an unambiguous and correct user of the travel adapter in the intended country can be guaranteed. With the aid of this travel adapter, the user is spared the need to try out several different plugs in the respective country. This in turn not only improves handling but also assures a high degree of safety during its use. Moreover, the further plug and the further first contact pin and further second contact pin may be arranged on a gear mechanism as described previously.

A contact clasp or contact extension may be arranged on the at least one of the plugs or on the first contact pin and the second contact pin. A contact clasp may be designed as an elastically resilient metal plate which may thus be arranged reproducibly against the contact elements in the receptacle and thereby enable a reliable electrical contact. The contact extensions are of simple construction and can easily be connected to the contact elements of the receptacle, wherein a reliable electrical contact is produced.

The travel adapter may include a seating for an overcurrent protection. Travel adapters are used in various countries with different energy networks. An overcurrent protection is therefore beneficial for the safe use of the travel adapter and may be essential in view of country-specific certification regulations. If a damaged device is connected to the travel adapter, the overcurrent protection prevents the travel adapter from being damaged, as this triggers the overcurrent protection. The seating guarantees that the overcurrent protection can be replaced easily.

In particular, the seating is arranged on the receptacle housing. This enables the seating and thus the overcurrent protection arranged therein as well to be arranged close to the contact sockets.

The seating may be arranged opposite the receptacle. This helps to keep the size of the travel adapter small.

In particular, the overcurrent protection is a fuse. Fuses can be produced for various overcurrent protection classes and they have a compact structure and low dead weight.

In the position in which it is extended out of the receptacle housing, the seating is advantageously not separable from the receptacle housing. This makes it impossible for the seating to be lost. At the same time, it may also serve to ensure that the contact sockets or contact elements in the receptacle housing cannot be touched.

The travel adapter may be equipped with a locking apparatus for locking the seating. The locking apparatus prevents access to the overcurrent protection when one of the plugs or contact pins is in its operating position. This further enhances safe use of the travel adapter.

The locking apparatus may be constructed in at least two parts and includes a locking cam and a locking groove. The locking cam and the locking groove engage fixedly with each other and prevent the seating from being opened.

The locking groove may be arranged on the housing and the locking cam on the seating. This enables these elements of the locking apparatus on the travel adapter to interact reliably.

In particular, with a receptacle housing in a certain position the locking groove and the locking cam may be brought into an operative connection so that the seating can be detached from the receptacle housing. This position is different from any operating position of the plugs or contact pins. This guarantees that the overcurrent protection can only be removed if all plugs or contact pins are in their rest positions, and consequently that the travel adapter is not in electrical contact with an external energy network.

The travel adapter may have an interface which makes it possible to arrange an additional module on the travel adapter and connect said additional module electrically with the receptacle. This also makes it possible to connect an electrical device to the travel adapter, thereby further improving the application range of the travel adapter described here.

The interface advantageously has an electrical contact, which interacts with an electrical contact on the additional module with the result that the additional module can be supplied with electrical energy.

In particular (but not exclusively), the additional module is selected from the group including a USB charger module, mobile rechargeable battery module, Bluetooth® module, WiFi module, wireless charger module, IoT (Internet of Things) module, nightlight module, storage compartment module for a cable, smartphone bracket module, smart meter module (particularly with voltage, current and power display), key finder module, smoke alarm module, insect repellent module or room fragrancing module. For example, an electrical device such as a smartphone, a Tablet or a music playback device may be connected to the USB charger module, so that the rechargeable battery arranged inside it can be charged.

The travel adapter may have at least one recessed grip for twisting the receptacle. The at least one recessed grip makes it easier for the user of the travel adapter to manipulate the travel adapter. The user can hold the travel adapter firmly with one hand and twist the receptacle of the travel adapter into the desired position with the other hand.

This recessed grip may be arranged on the receptacle housing. This has the effect of improving the handling of the travel adapter for the user and thus makes it easier to rotate the receptacle.

In particular, this recessed grip is arranged at the interface. Consequently, the recessed grip and the interface are arranged on the same component of the housing, so that the recessed grip and the interface can be manufactured in one work step. Optionally, the receptacle may be twisted by means of an additional arranged at the interface.

The travel adapter may have two recessed grips for twisting the receptacle. Then, for example, the user can insert one finger in each of the recessed grips and turn the receptacle. The two recessed grips enable a secure grip while twisting the receptacle. The two recessed grips are advantageously positioned opposite each other, thus enabling simple handling.

The receptacle in the receptacle housing may be compatible with plugs of the Brazilian, Italian and Swiss standards. In such a case, the receptacle in the receptacle housing may also be compatible with J type, L type or N type plugs N, thereby increasing the travel adapter's flexibility.

At least one actuation recess may be provided on the travel adapter for pivoting the plug out. After the use of the travel adapter has selected the plug corresponding to the desired standard and turned the receptacle to the position intended for this, the user can grasp the actuation recess and pivot the selected plug out of the housing easily and largely without resistance.

Alternatively or additionally, at least one actuation recess is provided on the travel adapter for pivoting out the first contact pins and the second contact pins. As described previously, the user can use the actuation recess to easily pivot the first contact pin and the second contact out of the housing, so that handling for the user is improved. The actuation recess further serves to ensure that all contact pins can be pivoted out of the housing.

A latching cam may be arranged on the plug in order to cooperate with the housing in such manner that the plug can be locked in place both in a rest position in the housing and in an operating position when pivoted out. In this way, the plug is prevented from being moved unintentionally from either the rest position or the operating position in which it is pivoted out, thereby improving the operating safety of the travel adapter.

Alternatively or additionally, a latching cam is arranged on the first contact pins and the second contact pins to cooperate with the housing in such manner that the first contact pin and the second contact pin can be locked in place both in a rest position in the housing and in an operating position when pivoted out. In this way, the contact pins are prevented from being moved unintentionally from either the rest position or the operating position in which they are pivoted out, thereby improving the operating safety of the travel adapter.

At least one extension element may be arranged on the housing. The at least one extension element enables the receptacle housing to rest securely on an external receptacle when the travel adapter with a plug or a first contact pin and a second contact pin is arranged in the external receptacle.

The housing of the plug according to the British standard may haves at least one extension element. The extension element enables the relatively broad contact pins conforming to the British standard to be arranged in space-economical manner in the travel adapter housing.

In addition, a standard for travel adapters, for example the British standard, may specify a minimum base area for the housing side of the travel adapter on which the plug or the contact pins are arranged. Moreover, this standard ora further standard may require that when pivoted out the contact pins are at a prescribed distance from at least one edge region of the housing side. In order to satisfy the required base area or the distance from at least one edge region prescribed therefor according to said standard, the travel adapter described in this document advantageously includes at least one extension element.

In particular, the at least one extension element is movable into an activation position via a guide slot by pivoting the plug out. The guide slot enables controlled movement of the at least one extension element into its activation position, allowing multiple movements of the at least one extension element to be carried out with no wearing of the components.

Alternatively or additionally, the at least one extension element is movable into an activation position via a guide slot by pivoting the first contact pin and the second contact pin out. This makes it possible to dispense with an additional drive mechanism for moving the extension elements, allowing the construction of the travel adapter to be lightweight and compact.

In the activation position, the extension elements are extended far enough out of the housing to ensure that the base area resulting therefrom on the housing side satisfies the applicable standard.

Conversely, in the inactive position the extension elements are arranged inside the housing so that the travel adapter is kept as compact as possible. In this way, the features of the travel adapter that are advantageous for the user, such as light weight, small size and compact construction are fulfilled satisfactorily.

In particular, at least one further extension element is arranged on the housing and is movable into an activation position via a guide slot by pivoting the first contact pin and the second contact pin out. The at least one further extension element enables the receptacle housing to bear more securely still on an external receptacle.

A further travel adapter according to the invention comprises a housing, at least one receptacle of a first standard and at least one plug of a second standard, wherein the receptacle of the first standard includes at least one first contact socket and a second contact socket, and the plug of the second standard has at least one first contact pin and a second contact pin. The first contact pin is connected electrically to the first contact socket, and the second contact pin is connected electrically to the second contact socket. The first contact pin and the second contact pin are arranged so as to be movable on the housing. At least one extension element is arranged on the housing, and said extension element is movable in an activation position.

The at least one activated extension element enables a standard-compliant base area and stable positioning of the travel adapter housing on an external receptacle (mains socket), when the first contact pin and the second contact pin are arranged in the contact sockets of an external receptacle. The at least one extension element also enables a compact construction of the travel adapter, so that the size of the travel adapter can be reduced further. The activation position of the at least one extension element may then be reached when the first contact pin and the second contact pin are in their operating positions. Conversely, the extension elements may be in an inactive position when the first contact pin and the second contact pin are in their rest positions. In the inactive position, sections of the extension elements are arranged in the housing, and together with the housing sides form a space-saving, compact unit. The extension elements may be shifted from the inactive position to their activation position by a user, particularly manually, and shifted back into the inactive position again manually, for example. In this way, the features of the travel adapter that are advantageous for the user, such as light weight, small size and compact construction may be fulfilled satisfactorily.

The operating position of the first contact pin and the second contact pin is the extended end position in which the first contact pin and the second contact pin can be plugged into an external or separate receptacle. Conversely, a rest position is the retracted end position in which at least sections of the first contact pin and the second contact pin are located in the housing.

The at least one extension element may be arranged on the housing in such manner that it can be moved into an activation position when the first contact pin and the second contact pin are moved out.

Alternatively, the travel adapter may be equipped with a trigger mechanism for activating the at least one extension element. In this case, the user can activate the trigger mechanism, via a release button, for example, which releases the at least one extension element so that it is moved from its inactive position into its activation position. In such a case, the trigger mechanism may have a gear mechanism which may be arranged inside the housing of the travel adapter and which connects the release button to the contact pins, so that the contact pins can be moved out of the housing by means of the gear mechanism. The release button may be arranged on the travel adapter housing so that it is easily accessible by the user.

The plug may be equipped with a further extension element, wherein this element may be moved into an activation position by moving the first contact pin and the second contact pin out.

In the activation position, the extension elements are extended far enough out of the housing to ensure that the base area resulting therefrom on the housing side satisfies the applicable standard. Conversely, in the inactive position the extension elements are arranged inside the housing so that the travel adapter is kept as compact as possible.

In particular, the plug is designed according to the British standard, wherein the first contact pin and the second contact pin are broader, and in accordance with the standard positioned relatively farther apart from each other than is the case in other standards. These broad contact pins and their distance from each other require relatively more space in the housing of a travel adapter. The extension elements described here are particularly suitable for a travel adapter with a plug according to the British standard in order for the travel adapter to be made particularly compact.

In particular, the at least one and the further extension element are each movable in a guide slot. The guide slots enable said extension elements to be moved securely into their activation positions, allowing multiple movements of said extension elements to be carried out with no wearing of the components. This makes it possible to dispense with an additional drive mechanism for moving the extension elements, allowing the construction of the travel adapter to be lightweight and compact.

The first contact pin and the second contact pin may be coupled to one another in such manner that they can be moved out of the housing together. The first contact pin and the second contact pin may thus be moved synchronously from their rest position into their operating position. Accordingly, they reach their operating position at the same time, so that the user is able to plug them into an external or separate receptacle without difficulty.

Advantageously, at least the first contact pin and the second contact pin are movable out of the housing linearly. In this operation, the two contact pins may be moved out of the housing with the aid of contact pin guides.

Advantageously, at least the first contact pin and the second contact pin may be pivoted out of the housing. In this way, said contact pins may be moved out of the housing and also back into the housing particularly easily.

The first contact pin and the second contact pin may be coupled to one another in such manner that they are movable out of the housing together. The first contact pin and the second contact pin may thus be moved synchronously from their rest position into their operating position. Accordingly, they reach their operating position at the same time, so that the user is able to plug them into an external or separate receptacle without difficulty.

The receptacle may include a third contact socket, which is connected to a third contact pin, which is movable out of the housing and is a protective earth pin. This enables the travel adapter also to be used in those countries in which a protective conductor system is mandatory.

In particular, the first contact pin and the second contact pin and the third contact pin are coupled to one another in such manner that they are movable out of the housing together. The coupling of the contact pins enables all three contact pins to be moved synchronously, so that they can be moved into their respective operating positions without difficulty.

The first contact pin and the second contact pin may be pivoted out in a first pivot direction, and the third contact pin may be pivoted out in a second pivot direction, opposite to the first pivot direction. This makes it possible for the contact pins to arranged in space-saving manner in the rest position in the travel adapter housing. The third contact pin is constructed as the protective earth pin, so that it is pivotable in the opposite direction to the first and the second contact pins.

The third contact socket may be furnished with a slot. In this way, the Swiss plug standard, the Italian plug standard and the Brazilian plug standard can be satisfied with one and the same receptacle.

The travel adapter may have an interface which makes it possible to arrange an additional module as described herein on the travel adapter and to connect the additional module arranged on the interface electrically with the receptacle. This also makes it possible to connect an electrical device to the travel adapter, thus further improving the application range of the travel adapter described here.

The interface advantageously has an electrical contact, which interacts with an electrical contact on the additional module, with the result that the additional module can be supplied with electrical energy.

A set according to the invention comprising one of the travel adapters such as described herein and a plug adapter. The plug adapter includes a plug adapter housing, on which a plug is arranged so as to cooperate with the receptacle of the travel adapter and one or more receptacles of various standards. In this context, the plug adapter may have a substantially disc-like plug adapter housing, so that the set in the assembled state may be of compact structure. In this context, the plug of the plug adapter conforms to a first standard, so that it can advantageously be plugged into the receptacle of the travel adapter. Thus, the plug of the plug adapter may be connected electrically to the contact sockets of the receptacle, and in turn enabling an electrical device of a first standard which is connected to the receptacle of the plug adapter to be connected electrically to an external receptacle of a second standard.

The receptacle of the plug adapter advantageously comprises a number of standards, so that devices with plugs of various standards can be connected to this receptacle. This further enhances the flexibility of the travel adapter and/or the set.

The set may comprise one of the travel adapters such as are described herein and an additional module for cooperating with the interface of the travel adapter. In this way, the flexibility of the set, as described previously, may be improved further.

Further advantages, features and particularities of the invention may be discerned from the following description, in which embodiment of the invention are described with reference to the figures. Numerations such as first, second, third or further serve solely to identify the components.

BRIEF DESCRIPTIONS OF THE DRAWINGS

The list of reference signs is an integral part of the disclosure in the same way as the technical content of the claims and figures. The figures are described sequentially and associatively. Identical reference numerals denote identical components, reference numerals with different indices indicate functionally equivalent or similar components.

Figure 2:
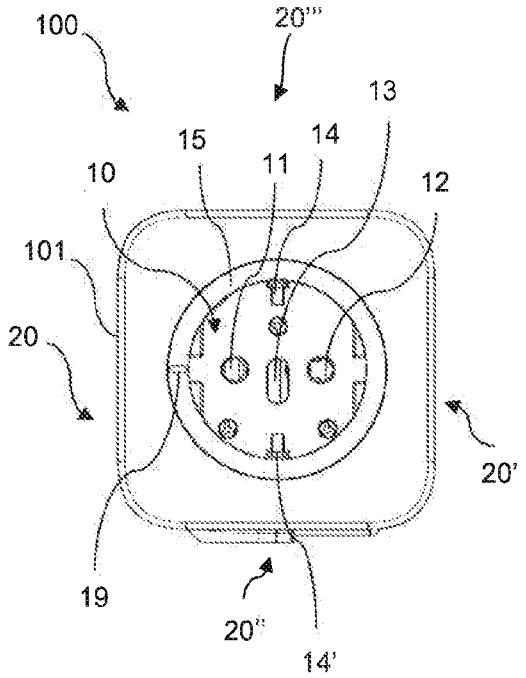
Figure 3:
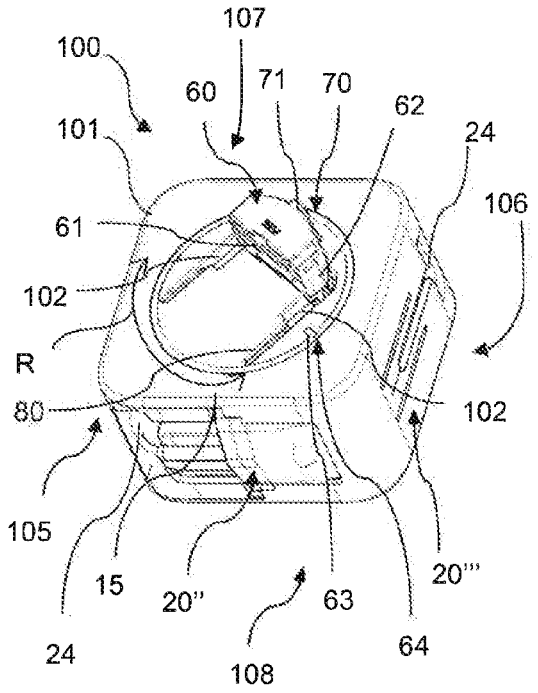
Figure 4:
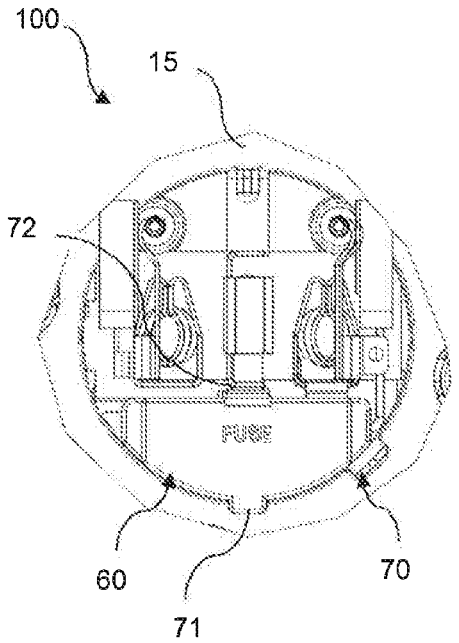
Figure 5:
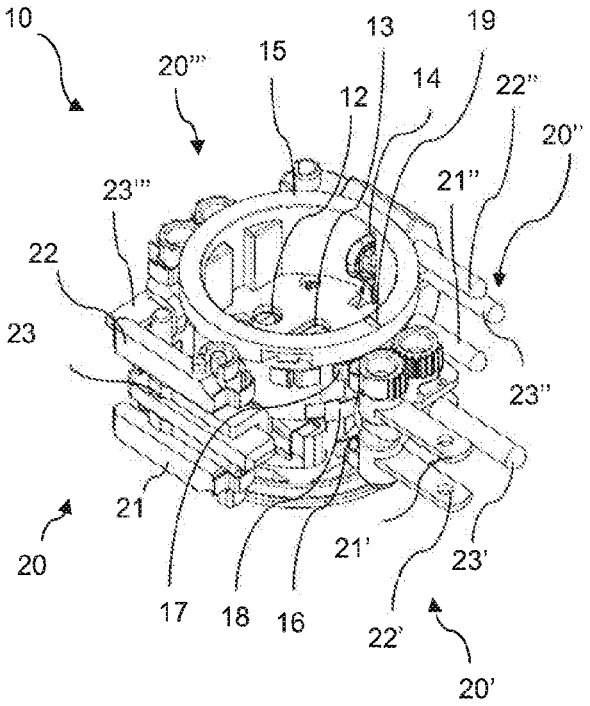
Figure 6:
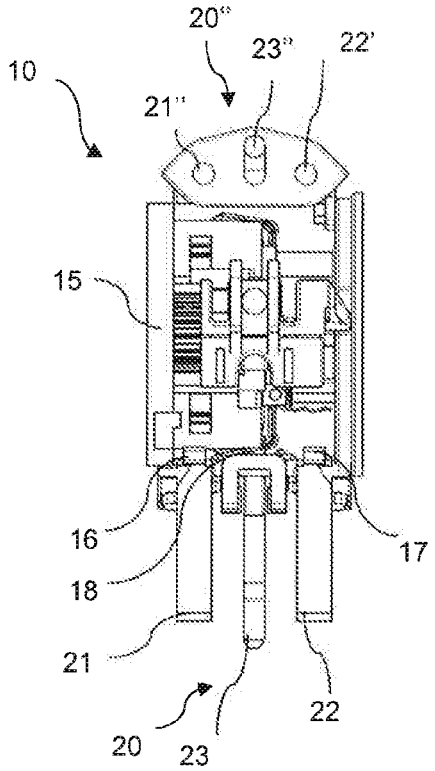
Figure 7:
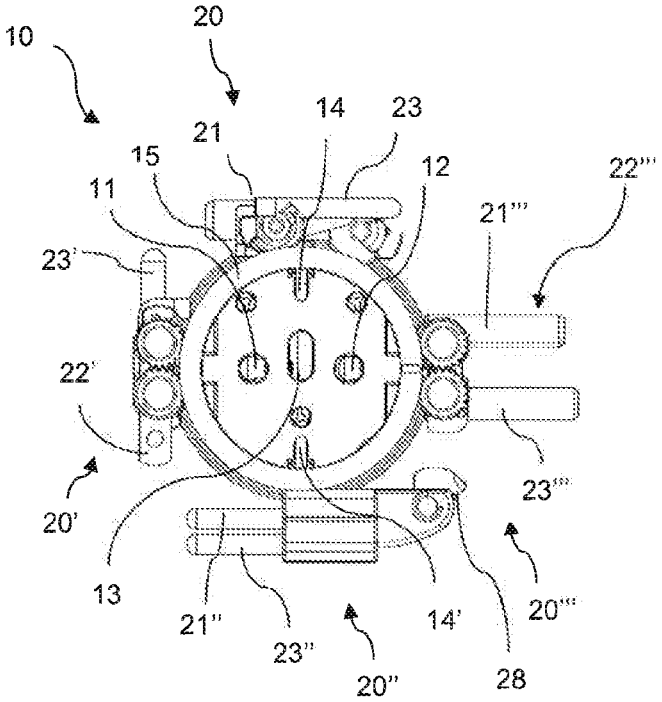
Figure 8:
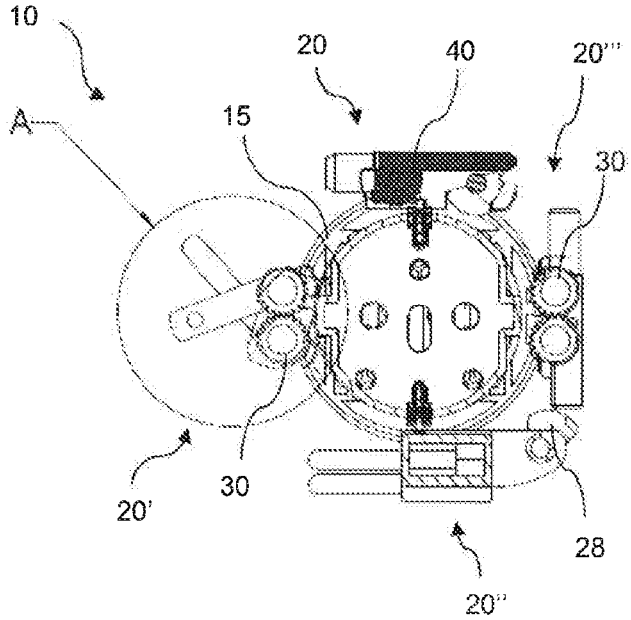
Figure 9:
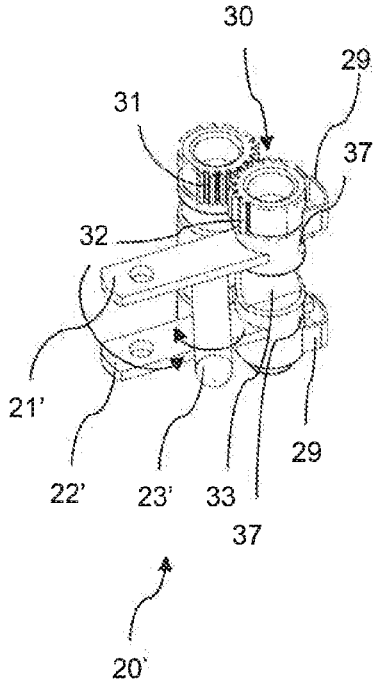
Figure 9A:
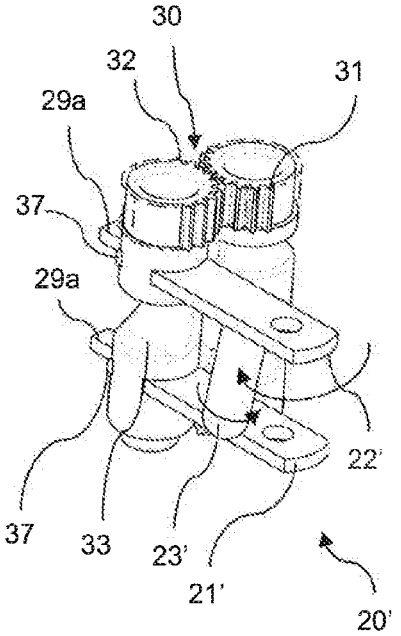
Figure 9B:
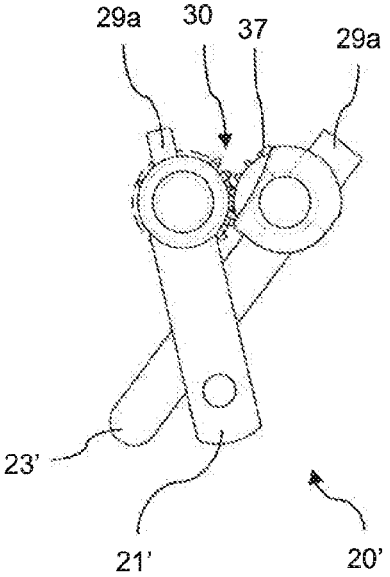
Figure 10:
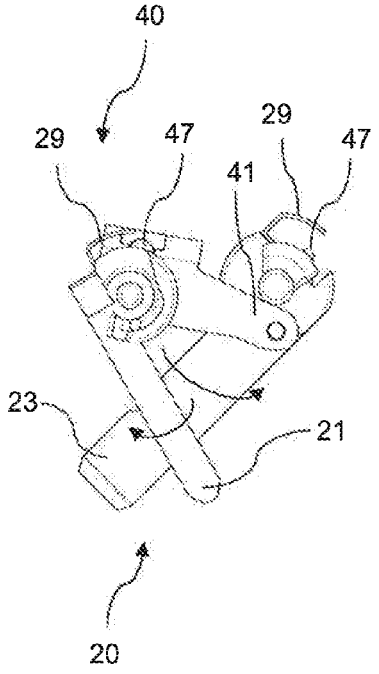
Figure 11:
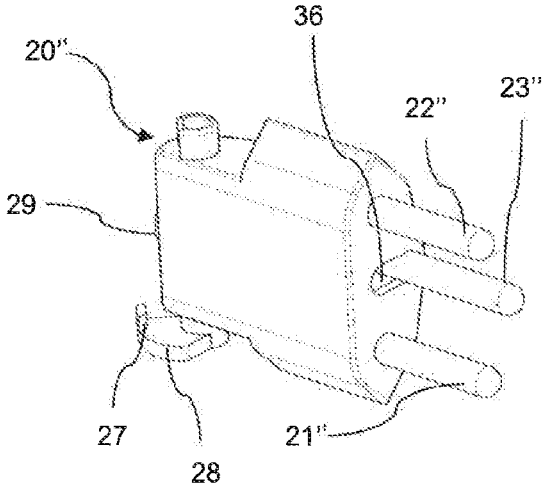
Figure 12:
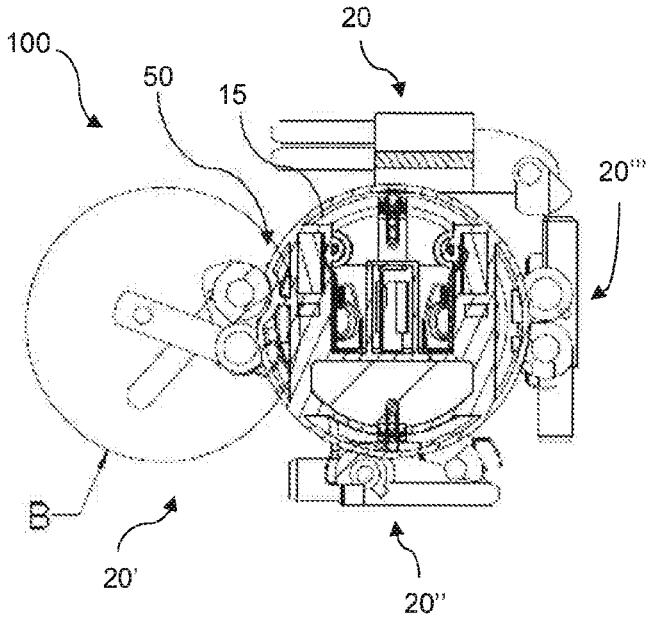
Figure 13:
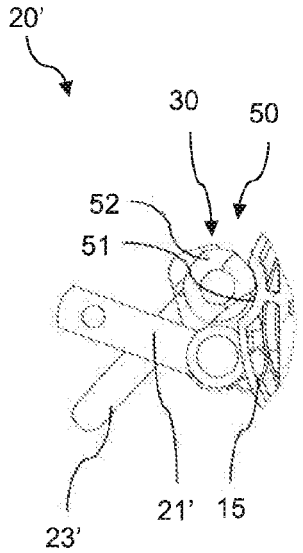
Figure 14:
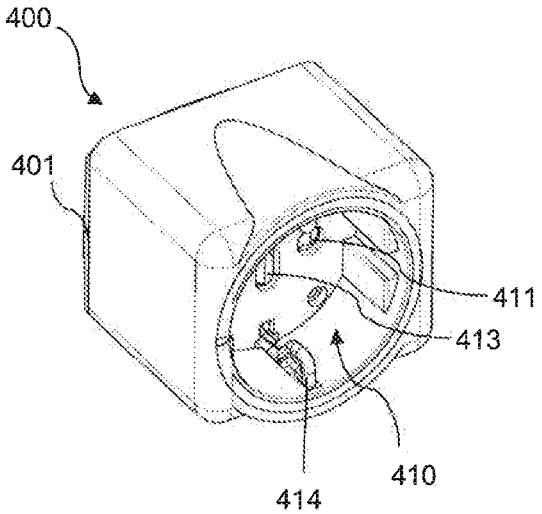
Figure 15:
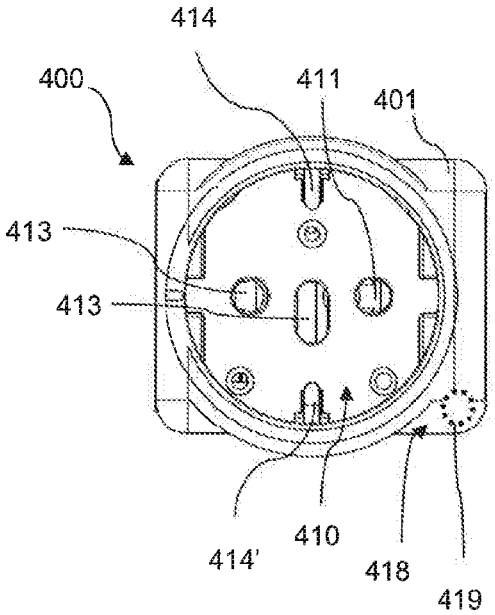
Figure 16:
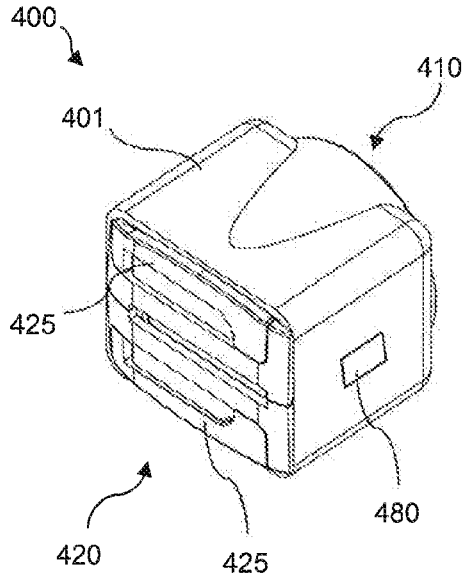
Figure 17:
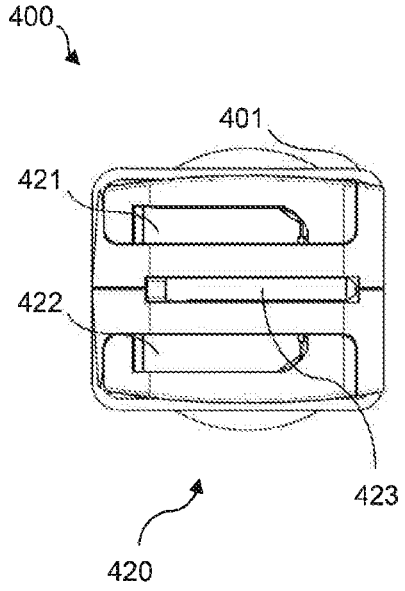
Figure 18:
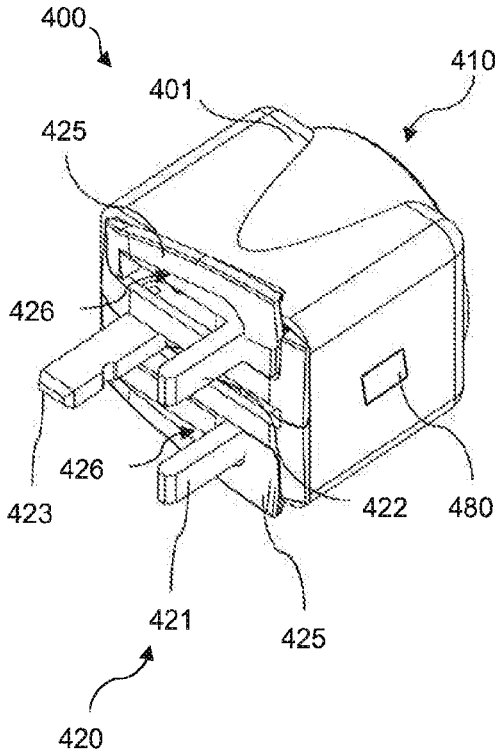
Figure 19:
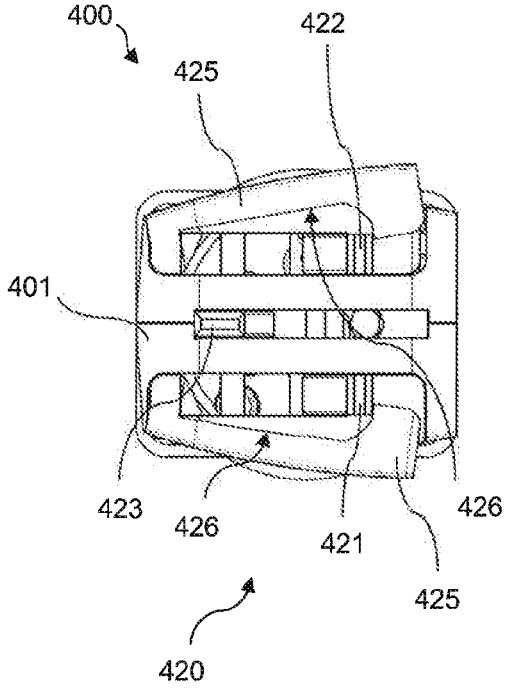
Figure 20:
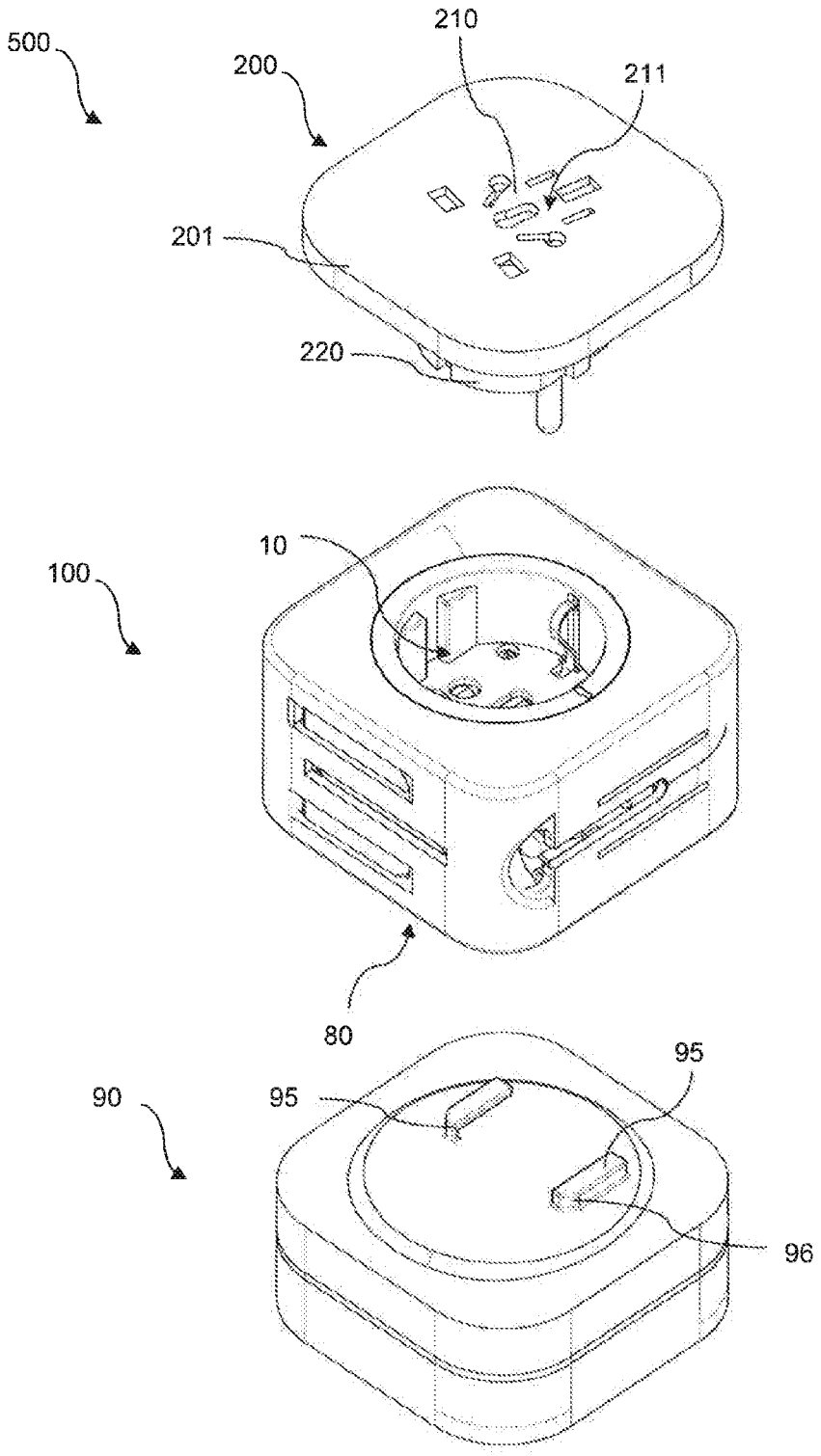

In the drawing:

FIG. 1 shows a first perspective view of a travel adapter according to the invention, FIG. 2 shows a plan view of the travel adapter of FIG. 1, FIG. 3 shows a further perspective view of the travel adapter of FIG. 1, FIG. 4 shows a detail view of the travel adapter of FIG. 3, FIG. 5 shows a perspective view of the receptacle of the travel adapter of FIG. 1 without housing, FIG. 6 shows a side view of the receptacle of FIG. 5, FIG. 7 shows a first top view of the receptacle of FIG. 5, FIG. 8 shows a first cross sectional view of the receptacle of FIG. 5, FIG. 9 shows a perspective view of a plug of a first standard of the travel adapter along cross section A in FIG. 8, FIG. 9*a* shows a perspective view of a plug of a first standard in a further variant according to FIG. 9, FIG. 9*b* shows a top view of the plug of FIG. 9*a*, FIG. 10 shows a view of a plug of a second standard of the travel adapter according to FIG. 1, FIG. 11 shows a perspective view of a third plug of the travel adapter, FIG. 12 shows a further cross sectional view of the receptacle of FIG. 5, FIG. 13 shows a top view of plug of a further standard along cross section B in FIG. 12, FIG. 14 shows a perspective view of a further travel adapter according to the invention, FIG. 15 shows a first top view of the travel adapter of FIG. 12, FIG. 16 shows a further perspective view of the travel adapter of FIG. 12, FIG. 17 shows a further top view of the travel adapter of FIG. 12, FIG. 18 shows a further perspective view of the travel adapter of FIG. 12, FIG. 19 shows a further perspective view of the travel adapter of FIG. 12, and FIG. 20 shows a perspective view of a set according to the invention (exploded view).

DETAILED DESCRIPTION OF THE INVENTION

FIGS. 1 to 4 show various views of a travel adapter 100 according to the invention. The travel adapter 100 comprises a housing 101, in which a receptacle 10 is arranged, and in which several plugs 20, 20', 20", 20'" of different standards are arranged. The receptacle 10 is designed to accommodate external plugs of various standards. The receptacle 10 has a receptacle housing 15, in which a first contact socket 11, a second contact socket 12 and a third contact socket 13 are arranged. The contact sockets 11, 12, 13 are designed to accommodate contact pins of external plugs (mains plugs) of various standards and to cooperate therewith. The receptacle housing 15 further contains contact blades 14, 14', which are also able to cooperate with the contacts of an external plug and are connected electrically to the contact socket 13.

The receptacle 10 is mounted in the housing 101 so as to be pivotable in the directions of rotation R, and the plugs 20, 20', 20", 20'" are arranged on the respective housing sides 105, 106, 107, 108 of the housing 101, being offset by 90° with respect to each other and arranged pivotably on the housing 101. When the receptacle 10 is twisted to the respective housing side 105, 106, 107, 108 relative to the housing 101, the respective plug 20, 20', 20", 20'" or the first contact pin 21, the second contact pin 22 and the third contact pin 23 are pivoted out of the housing 101. Only the plug 20, 20', 20", 20'" that was chosen by the user is pivoted out of the housing 101 and into its operating position. The selection of the respective plug 20, 20', 20", 20'" is indicated visually with the aid of the selection marking 19. Actuation recesses 24 for pivoting each of the plugs 20, 20', 20", 20'" out are arranged on the housing sides 105, 106, 107, 108 on the housing 101. The actuation recesses 24 allow a user to reach into the housing 101 so that the plug 20, 20', 20", 20'" chosen in each case may be pivoted out of the housing manually. The other plugs 20, 20', 20", 20'" remain in their respective rest positions, pivoted into the housing 101 and are at least partly covered by extension elements 25. The extension elements 25 are movable into an activation position via a guide slot 26 by pivoting the contact pins 21, 22, 23 out. In the activation position, the extension elements 25 may protrude beyond the housing edges, so that the housing 101 is extended on this housing side 105.

A seating 60 is arranged on the receptacle housing 15 on the side of the housing 101 opposite the receptacle 10. This seating 60 holds an overcurrent protection 61. If the seating 60 and the overcurrent protection 61 arranged therein positioned inside the receptacle housing 15, the overcurrent protection 61 is connected electrically for example with the first contact socket 11. The seating 60 includes a seating guide 62, with which the seating 60 and therewith the overcurrent protection 61 as well may be guided into the receptacle housing 15. In the extended position, the seating 60 is connected to the receptacle housing 15.

The travel adapter 100 is equipped with a locking apparatus 70 for locking the seating 60. The locking apparatus 70 prevents access to the overcurrent protection 61 when one of the plugs 20, 20', 20", 20'" is in its operating position. The locking apparatus 70 can only be unlocked when the receptacle 10 is turned in the directions of rotation R as far as the locking marking 63 and the plugs 20, 20', 20", 20'" are in their rest positions. The locking apparatus is constructed in two parts and has a locking cam 71 and a locking groove 72, wherein the locking groove 72 is arranged on the receptacle housing 15 and the locking cam 71 is arranged on the seating.

The travel adapter 100 has two recessed grips 102 on the receptacle housing 15, which are used to twist the receptacle 10 in the directions of rotation R, so that it can be turned in a position relative to the housing 101 in which the seating 60 can be extended out of the receptacle housing 15. This position corresponds to the locking position 64 on the receptacle housing 15.

The travel adapter 100 has an interface 80 on the side thereof opposite the receptacle 10, which makes it possible to arrange an additional module on the travel adapter 100 and to electrically connect the additional module arranged on the interface 80 with the receptacle 10.

FIGS. 5 to 7 show the receptacle 10 of the previously described travel adapter 100 with the plugs 20, 20', 20", 20'" arranged thereon, wherein the housing 101 is not shown in these figures. The plugs 20, 20', 20", 20'" are designed according to the British standard (plug 20), the US standard (plug 20'), the Swiss standard (plug 20") and the Australian standard (plug 20'"). Plugs of other standards may also be arranged on a travel adapter 100 as described here. The plugs 20, 20', 20", 20'" each have a first contact pin 21, 21', 21", 21'" and a second contact pin 22, 22', 22", 22'". The plugs 20, 20', 20", 20'" illustrated require a protective earth pin according to their respective standards, this pin being represented as third contact pin 23, 23', 23", 23'". Contact elements 16, 17, 18 are arranged in the receptacle housing 15, said contact elements being connected electrically to the first contact socket 11, the second contact socket 12 and the third contact socket 13 respectively and/or to the contact blades 14, 14' of the receptacle 10. In this context, the third contact pin 23, 23', 23", 23'" forms a protective ground connection with the contact blades 14, 14' of the receptacle 10 and/or with the third contact socket 13 and with the contact element 18. The contact elements 16, 17, 18 in the receptacle housing 15 can each be connected electrically to the respective plug 20, 20', 20", 20'" by twisting the receptacle 10 relative to the housing 101. For this purpose, the contact elements 16, 17, 18 are brought into contact and thus connected electrically with the respective first contact pin 21, 21', 21", 21'", with the respective second contact pin 22, 22', 22", 22'", and with the respective third contact pin 23, 23', 23", 23".

Plugs according to a standard which does nor require a protective earth pin do not have a third contact pin 23, 23', 23", 23'". In such cases, the contact element 18 which is electrically connected to the contact socket 13 or to the contact blades 14, 14', is electrically insulated from a plug which does not have a third contact pin 23, 23', 23", 23'" by being covered by the housing or by plug sheathing (not shown).

The selection marking 19 on the receptacle housing 15 (FIG. 2) is located in the region above the contact elements 16, 17, 18, so that the user of the travel adapter 100 can see which plug 20, 20', 20", 20'" the contact sockets 11, 12, 13, 14, 14' are electrically connected to. The selected plug 20, 20', 20", 20'" in each case, or the contact pins 21, 22, 23; 21', 22', 23', 21", 22", 23"; 21'", 22'", 23'" thereof are pivoted out of the housing by the user. The first contact pin 21, 21', 21", 21, the second contact pin 22, 22', 22", 22'" and the third contact pin 23, 23', 23", 23'" are coupled to one another in such manner that they can be pivoted out of the housing together. A gear mechanism is provided for each in order to couple the contact pins 21, 22, 23; 21', 22', 23', 21", 22", 23"; 21', 22'", 23'". The contact pins 21", 22", 23" can only be pivoted out together with the plug 20", a pivot apparatus 28 being arranged on plug 20" for this purpose.

As shown in FIGS. 8 to 10, gear mechanisms arranged on the receptacle housing 15 are used to couple the contact pins 21, 22, 23; 21', 22', 23', 21", 22", 23"; 21'", 22'", 23'". The contact pins 21, 22, 23; 21', 22', 23', 21", 22", 23"; 21'", 22'", 23'" are equipped with contact clasps 29, which each cooperate with the contact elements 16, 17, 18 on the receptacle if one of the plugs 20, 20', 20", 20'" is in its operating position. In the present case, the contact clasps 29 are embodied as elastically resilient metal plates, representing one of the possible variants of a detachable electrical connection. The gear mechanisms are embodied either as gear mechanisms 30 or as coupling rod gear mechanisms 40. By creating a mechanical coupling, a gear mechanism enables the respective contact pins 21, 22, 23; 21', 22', 23', 21', 22'", 23'" to be pivoted out together, so that they may be moved into their operating position and/or rest position synchronously. Latching cams 37, 47 are also provided on the gear mechanism of the plug 20, 20', 20", 20'" to cooperated with the housing 101 of the travel adapter 100 in such manner that the plug 20, 20', 20", 20'" can be held in place in the rest position in the housing 101 and in an operating position in which it is pivoted out.

A gear mechanism 30, such as is shown in FIG. 9 connects the contact pins 21', 22', 23'. The gear mechanism 30 is furnished with tooth systems 31, 32 which mesh with each other and enable the contact pins 21', 22', 23' to be pivoted out together. The tooth systems 31, 32 rotate in symmetrically opposite directions. A gearing notch 33 is arranged on the gear mechanism, so that the third contact pin 23' when retracted in its rest position is seated in the gearing notch 33, thereby allowing the size of the travel adapter to be minimised.

A coupling rod gear mechanism 40 as shown in FIG. 10 connects the contact pins 21, 22, 23. The coupling rod gear mechanism 40 includes a connecting rod 41 which enables the contact pins 21, 22, 23 to be pivoted out together. In the example illustrated, the contact pins 21 and 22 are aligned congruently, so only the contact pin 21 can be shown.

As illustrated in FIGS. 9 and 10, the first contact pin 21, 21' and the second contact pin 22, 22' are pivotable outwards in a first pivot direction, and the third contact pin 23; 23' is pivotable outwards in a second pivot direction opposite to the first pivot direction.

FIG. 9*a* and FIG. 9*b* show a further variant of the plug 20' according to FIG. 9. This plug 20' has contact extensions 29*a*, each of which cooperates with the contact elements 16, 17, 18 on the receptacle housing 15 if the plug 20' is in its operating position. As explained here, the contact extensions 29*a* extend through the gear mechanism 30 and can be connected to the contact elements 16, 17, 18 and are held securely. The contact elements on the receptacle housing are elastically resilient, constructed for example as contact clasps (not shown).

FIG. 11 shows a plug 20" according to the Swiss standard, the Italian standard and the Brazilian standard, wherein these standards are selectable. For this purpose, the third contact pin 23" designed as the protective earth pin can be moved linearly. The protective earth pin is arranged so as to be movable linearly in a slot 36 between the first contact pin 21" and the second contact pin 22". When plug 20" has been pivoted out with the pivot apparatus 28 and after the latching cam 27 has locked on the housing 101, the user can move the protective earth pin into at least three positions along the slot 36.

FIGS. 12 and 13 shows the travel adapter 100 and an unlocking mechanism 50, which allows each of the plugs 20, 20', 20", 20'" individually or their contact pins to be pivoted out when the receptacle 10 and the selection marking 19 appears in the respective operating position of the selected plug 20' (see for example FIG. 5). At the same time, the unlocking mechanism 50 prevents the other plugs 20, 20", 20'" or their contact pins from pivoting out, so they are forced to remain in their rest position.

The unlocking mechanism 50 includes an unlocking guide channel 51 and an engaging element 52. The unlocking guide channel 51 and the engaging element 52 cooperate in such manner as to ensure reliable unlocking. In this situation, the engaging element 52 is arranged on the gear mechanism 30 of the plug 20' and the unlocking guide channel 51 is arranged on the receptacle housing 15.

FIGS. 14 to 19 show various views of a further travel adapter 400 according to the invention. The travel adapter 400 comprises a housing 401 in which a receptacle 410 with a first standard is arranged and in which a plug 420 with a different standard from the first standard is arranged. The illustrated standard of plug 420 corresponds to the British standard. The receptacle 410 is designed to accommodate external plugs of various standards. For this purpose, the receptacle has a first contact socket 411, a second contact socket 412 and a third contact socket 413 and contact blades 414, 414'. The third contact socket 413 is furnished with a slot, so that an external plug according to the Swiss plug standard, the Italian plug standard and the Brazilian plug standard can be arranged in the receptacle 410, for example a plug such as is shown in FIG. 11.

The plug 420 is arranged on the side of the housing 401 opposite the receptacle 410. The plug 420 has a first contact pin 421 and a second contact pin 422, wherein the first contact socket 412 is electrically connected to the first contact socket 411 and the second contact pin 422 is electrically connected to the second contact socket 412. The plug 420 also has a third contact pin 423, which is a protective earth pin and is electrically connected to the third contact socket 413 or to the contact blades 414, 414'.

The contact pins 421, 422, 423 are arranged movably on the housing 401, so that they can be pivoted out of the housing 401. Their end position when pivoted out of the housing 401 is called the operating position (FIG. 18). In the operating position, the contact pins 421, 422, 423 can be introduced into the respective contact sockets of an external plug. Conversely, the rest position is the end position after pivoting inwards, in which the contact pins 421, 422, 423 are located in the housing 401 (FIG. 16).

As was described earlier with reference to FIG. 9 or FIG. 10, the contact pins 421, 422, 423 are coupled to one another in such manner that they can be moved out of the housing 401 together. For this purpose, the travel adapter 400 is equipped with a gear mechanism and the contact pins 21, 22 and the contact pin 23 follow different pivot directions.

Extension elements 425 are arranged on the housing 401 and are movable into an activation position by moving the first contact pin 421 and the second contact pin 422 outwards. Each of the extension elements 425 is movable via a guide slot 426, as was described earlier with reference to FIG. 1.

In an alternative design of this travel adapter (as shown in FIG. 15), the extension elements may optionally be activated with the aid of a trigger mechanism. The user can activate the trigger mechanism 418 by means of a release button 419 (dashed circle) for example, which releases the extension elements 425, so that they are moved from their inactive position into their activation position. The contact pins 421, 422, 423 can subsequently be move out of the housing 401. The release button 419 may be arranged on the housing 401 of the travel adapter 400, so it is easily accessible to the user. A release slider may also be used as the release button 419.

The travel adapter 400 may include further elements of the travel adapter 100 according to FIGS. 1 to 13. For example, the travel adapter 400 has an interface 480 which makes it possible to arrange an additional module as described herein on the travel adapter 400 and to connect the additional module arranged on the interface 480 electrically to the receptacle 410.

FIG. 20 shows a set 500 according to the invention comprising a travel adapter 100 as described herein with an additional module 90 and a plug adapter 200. The plug adapter 200 has a plug adapter housing 201, on which a plug 220 is arranged to cooperate with the receptacle 10 of the travel adapter 100 and one or more receptacles 210 of different standard(s). The plug adapter 200 has a substantially disc-shaped plug adapter housing 201, so that the set 500 in the assembled state may be of compact structure. The plug 220 of the plug adapter 200 conforms to a first standard, while the receptacle 10 of the travel adapter 100 conforms at least to the same standard, so that the plug 220 is able to be plugged into the receptacle 10 of the travel adapter 100 and may therefore be connected electrically thereto.

The receptacle 210 of the plug adapter 200 conforms to several standards, so that contact pins of plugs conforming to an enormous variety of standards can be connected to this receptacle 210. For this purpose, the receptacle 210 has multiple contact sockets 211.

The travel adapter 100; 400 as described herein has an interface 80; 480 (see FIG. 3; FIG. 16). The additional module 90 has cams 95. In the assembled state, the interface 80; 480 of the travel adapter 100; 400 accommodates the cams 95 of the additional module 90, so that they cooperate mechanically. In this context, at least one cam 95 has an electrical contact 96, which can be electrically connected to a contact in the interface 80; 480, so that the additional module 90 can be supplied with electrical energy when the travel adapter 100; 400 is connected to an external energy supply.

The additional module 90 is for example either a USB charger module, mobile rechargeable battery module, Bluetooth module, WiFi module, wireless charger module, IoT (Internet of Things) module, nightlight module, storage compartment module for a cable, smartphone bracket module, smart meter module (particularly with a voltage, current and power display), key finder module, smoke alarm module, insect repellent module or fragrancing module. For example, an electrical device such as a smartphone, a Tablet or a music playback device may be connected to the USB charger module, so that the rechargeable battery arranged inside it can be charged.

The previously described set 500 may also comprise the travel adapter 400, as described previously and represented in FIG. 14 to FIG. 19 instead of the travel adapter 100.

The invention claimed is:

1. A travel adapter comprising:

a housing, at least one receptacle of a first standard and at least one plug of a second standard, wherein the at least one receptacle of the first standard has at least one first contact socket and one second contact socket, and the at least one plug of the second standard has at least one first contact pin and one second contact pin, wherein the plug is arranged on the housing and wherein the at least one receptacle is mounted pivotably in the housing and has a receptacle housing, wherein contact elements are arranged in the receptacle housing, each of which is connected to the first contact socket and the second contact socket of the at least one receptacle and which can be electrically connected to the first contact pin and the second contact pin of the respective plug by twisting the receptacle relative to the housing into an operating position corresponding to the respective plug, and wherein the at least one plug or the first contact pin and the second contact pin are arranged pivotably on the housing in such a way that the at least one plug or the first contact pin and the second contact pin can be pivoted out of the housing.

2. The Travel adapter according to claim 1, wherein the at least one receptacle has a contact blade and/or a third contact socket to create a protective ground connection, and the at least one plug has a third contact pin as a protective earth pin and the third contact pin is movable linearly, wherein a third contact element is arranged in the receptacle housing, and is connected to the contact blade and/or the contact socket, wherein the first contact pin and the second contact pin and the third contact pin are coupled to one another in such a way that they can be pivoted out of the housing together, wherein the first contact pin and the second contact pin can be pivoted out in a first pivot direction and the third contact pin can be pivoted out in a second pivot direction opposite to the first pivot direction.

3. The travel adapter according to claim 1, further comprising at least one further plug with a further standard arranged on the housing, wherein the further plug has at least one further first contact pin and one further second contact pin.

4. The travel adapter according to claim 1, further comprising a contact clasp or a contact extension arranged on at least one of the plugs or on the first contact pin and on the second contact pin.

5. The travel adapter of claim 1, further comprising an interface configured to mount an additional module, from the group consisting of a USB charger module, a mobile rechargeable battery module, a wireless connection module, or a Wi-Fi module, on the travel adapter and to connect the additional module electrically to the at least one receptacle.

6. The travel adapter according to claim 1, further comprising at least one recessed grip for twisting the receptacle, wherein said at least one recessed grip is arranged on the receptacle housing at the interface.

7. The travel adapter according to claim 1, further comprising a latching cam arranged on the plug and/or on the first contact pin and the second contact pin to cooperate with the housing in such a way that the plug and/or the first contact pin and the second contact pin can be held firmly in place in a rest position in the housing and in an operating position in which they are pivoted out.

8. The travel adapter according to claim 1, further comprising at least one extension element arranged on the housing, wherein the at least one extension element is movable into an activation position via a guide slot by pivoting the at least one plug out and/or by pivoting the first contact pin and the second contact pin out.

9. The travel adapter according to claim 1, wherein the first contact pin and the second contact pin are coupled to one another in such a way that they can be pivoted out of the housing together.

10. The travel adapter according to claim 9, further comprising a gear mechanism and/or a coupling rod gear mechanism, is provided to assure coupling, wherein a gearing notch is provided, particularly on the gear mechanism to accommodate at least one of the contact pins.

11. The travel adapter according to claim 1, further comprising an unlocking mechanism, which enables the respective plug or the first contact pin and the second contact pin to be pivoted out when the receptacle is located in the respective operating position.

12. The travel adapter according to claim 11, wherein the unlocking mechanism is constructed in at least two parts, and has an unlocking guide channel and an engaging element, wherein the unlocking guide channel is arranged on the at least one receptacle housing and the engaging element is arranged on the plug.

13. The travel adapter according to claim 1, further comprising a seating for an overcurrent protection, wherein the seating is arranged on the receptacle housing opposite the at least one receptacle.

14. The travel adapter according to claim 13, further comprising a locking apparatus for locking the seating, which locking apparatus is comprises at least two parts and includes a locking cam and a locking groove, wherein the locking groove is arranged on the housing and the locking cam is arranged on the seating, wherein the locking groove and the locking cam can be brought into operative connection when the receptacle housing is in a locking position, so that the seating can be released from the receptacle housing, which locking position is different for each operating position of the plugs or the contact pins.

15. A travel adapter comprising:

a housing, at least one receptacle of a first standard and at least one plug of a second standard, wherein the at least one receptacle of the first standard has at least one first contact socket and one second contact socket and the plug of the second standard has at least one first contact pin and one second contact pin, wherein the first contact pin is electrically connected to the first contact socket and the second contact pin is electrically connected to the second contact socket, and the first contact pin and the second contact pin are arranged movably on the housing; and wherein at least one extension element is arranged on the housing, wherein said at least one extension element is movable into an activation position via guide slot.

16. The travel adapter according to claim 15, further comprising an additional module configured to cooperate with an interface of the travel adapter, the additional module selected from the group consisting of a USB charger module, a mobile rechargeable battery module, a wireless connection module, or a Wi-Fi module, the additional module electrically connected to the travel adapter.

17. The travel adapter according to claim 15, further comprising a plug adapter having a plug adapter housing, on which a plug is arranged to cooperate with the at least one receptacle of the travel adapter and has one or more receptacles of different standards.

18. A travel adapter set comprising;

a travel adapter having a housing, at least one receptacle of a first standard and at least one plug of a second standard, wherein the at least one receptacle of the first standard has at least one first contact socket and one second contact socket and the at least one plug of the second standard has at least one first contact pin and one second contact pin, wherein the at least one plug is arranged on the housing and wherein the at least one receptacle is mounted pivotably in the housing and has a receptacle housing, wherein contact elements are arranged in the receptacle housing, each of which is connected to the first contact socket and the second contact socket of the at least one receptacle and which can be electrically connected to the first contact pin and the second contact pin of a respective plug by twisting the receptacle relative to the housing into an operating position corresponding to the respective plug, and wherein the at least one plug or the first contact pin and the second contact pin are arranged pivotably on the housing in such a way that the at least one plug or the first contact pin and the second contact pin can be pivoted out of the housing; and a plug adapter having a plug adapter housing, on which a plug is arranged to cooperate with the at least one receptacle of the travel adapter and has one or more receptacles of different standards.

19. The travel adapter set according to claim 18, further comprising an additional module configured to cooperate with an interface of the travel adapter the additional module selected from the group consisting of a USB charger module, a mobile rechargeable battery module, a wireless connection module, or a Wi-Fi module, the additional module electrically connected to the travel adapter.

20. The travel adapter set according to claim 18, wherein the first contact pin is electrically connected to the first contact socket and the second contact pin is electrically connected to the second contact socket.

* * * * *